US007523728B2

(12) United States Patent
Berndorfer

(10) Patent No.: US 7,523,728 B2
(45) Date of Patent: Apr. 28, 2009

(54) PHASER FOR CONTROLLING THE TIMING BETWEEN A CAMSHAFT AND A TIMING GEAR

(75) Inventor: Axel H. Berndorfer, Nittel (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/770,777

(22) Filed: Jun. 29, 2007

(65) Prior Publication Data

US 2007/0251476 A1 Nov. 1, 2007

Related U.S. Application Data

(63) Continuation of application No. 11/507,295, filed on Aug. 21, 2006, now abandoned.

(30) Foreign Application Priority Data

Aug. 22, 2005 (EP) ..... 05018206

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18, 90.27, 90.31; 464/1, 464/2, 160

See application file for complete search history.

(56) References Cited

U.S. PATENT DOCUMENTS

| | | | | |
|---|---|---|---|---|
| 5,184,578 | A | 2/1993 | Quinn, Jr. et al. | |
| 6,035,816 | A * | 3/2000 | Ogawa et al. | 123/90.17 |
| 7,234,427 | B2 | 6/2007 | Lehmann et al. | |
| 2005/0205032 | A1 | 9/2005 | Lehmann et al. | |

FOREIGN PATENT DOCUMENTS

WO WO 2004033860 A1 * 4/2004

* cited by examiner

*Primary Examiner*—Ching Chang
(74) *Attorney, Agent, or Firm*—Thomas N. Twome

(57) ABSTRACT

A phaser for controlling the timing between a camshaft and a timing gear having a rotor with at least one vane and a stator with at least one recess the phaser allowing limited rotational movement of the rotor with respect to the stator. The vane divides the recess into first and second pockets, wherein the introduction of a fluid into the first pocket causes the rotor to move in a first rotational direction relative to the stator, and in that the introduction of a fluid in the second pocket causes the rotor to move in the opposite rotational direction. A control ring is provided for selectively opening and closing a fluid connection between the pockets to allow fluid to flow between the pockets using the pressure difference of the fluid in each of the pockets to transport the fluid from the one to the other pocket.

9 Claims, 2 Drawing Sheets

PHASER FOR CONTROLLING THE TIMING BETWEEN A CAMSHAFT AND A TIMING GEAR

RELATIONSHIP TO OTHER APPLICATIONS AND PATENTS

This patent application is a continuation application of U.S. patent application Ser. No. 11/507,295 which was filed on Aug. 21, 2006 and which claims priority to European patent application serial number 05018206.2 which was filed on Aug. 22, 2005.

TECHNICAL FIELD

The present invention relates to a phaser for controlling the timing between a camshaft and a timing gear.

BACKGROUND OF THE INVENTION

An internal combustion engine has a crank-shaft driven by the connecting rods and pistons, and one or more camshafts which actuate the intake and exhaust valves of the cylinders. The camshaft is connected to a timing gear by means of a timing drive, such as a belt, chain or gears. In a variable cam timing system, the timing gear is replaced by a variable angle coupling, known as a phaser. The phaser is provided with a rotor connected to the camshaft in a housing or stator connected to the timing gear. This allows the camshaft to rotate independently of the timing gear, within angular limits, to change the relative timing of the camshaft and the crank-shaft. The term "phaser", as used in the present text, includes the stator and the rotor and all of the parts to control the relative angle of position of the stator and the rotor to allow the timing of the camshaft to be offset from the crank-shaft. In any of the multiple-camshaft engines, it will be understood that there could be one or more phasers per engine.

A phaser as described in the introduction is known in the prior art. Most variable camshaft phasers in production today are hydraulically activated devices, using vanes received in recesses, the vanes and the recesses enclosing fluid pockets, wherein the fluid pressure in the fluid pockets will control the angular position of the vane in the recess. The phasers, known in the prior art, are activated by oil pressure derived from an engine oil pump. One example of such a cam phaser is described in U.S. Pat. No. 6,035,816 by Ogawa et al. In this example, Ogawa et al. disclose a cam phaser with vanes received in recesses, the vanes and the recesses enclosing fluid pockets. The cam phaser utilizes an oil pump to feed oil to a control valve which in turn directs the oil to the appropriate fluid pockets in order to control the angular position of the vane in the recess. When oil is evacuated from a pocket, the oil is returned to an oil sump to be picked up by the pump at a later time.

In order to optimise the phaser performance, theoretically the capacity of such an engine oil pump should be as high as possible. However, the bigger the engine oil pump will be, the bigger the parasitic power losses the oil pump will cause. Therefore, a compromise must be found in order not to overlay fuel economy gains of the phaser with losses created by a larger engine oil pump.

SUMMARY OF THE INVENTION

It is an option of the present invention to increase the phaser performance with a given oil pump capacity. That means that the control of the phaser will be optimised, without the need of using a bigger engine oil pump.

According to the present invention this object is achieved in that a phaser is provided for controlling the timing between a cam shaft and a timing gear, comprising:

a rotor having at least one vane, the rotor being connectable to one of the camshaft and the timing gear for rotation therewith;

a stator, co-axially surrounding the rotor, provided with at least one recess for receiving the at least one vane of the rotor and allowing rotational movement of the rotor with respect to the stator, the stator being connectable to the other of the camshaft and the timing gear, wherein the vane divides the recess into a first pocket and a second pocket, the pockets being able to receive fluids under pressure, wherein the introduction of a fluid into the first pocket causes the rotor to move in a first rotational direction relative to the stator, and in that the introduction of a fluid in the second pocket causes the rotor to move in the opposite rotational direction relative to the stator;

wherein the phaser comprises control means for controlling the fluid pressure on opposite sides of the vanes to thereby control the angular position of the rotor with respect to the stator;

wherein the control means comprise means for selectively adjusting the timing of the opening and closing of a connection between the first and second pockets in order to allow fluid to flow between the pockets using the pressure difference of the fluid in each of the pockets to transport the fluid from the one to the other pocket.

Preferably the control means is capable of timing the opening of the connection between the first and second pockets with the occurrence of peak pressures in one of the first or second pockets, caused by the inherent torque reversals of the camshaft.

A phaser, according to the present invention is able to utilize oil pressure created internally in the phaser during the use thereof to improve phase rate performance.

The inherent torque reversals of the camshaft will create pressure pulsations in the pockets on either side of the rotor vanes, which are significantly higher than the engine oil pressure. Since the phaser according to the present invention can modulate the timing of opening and closing of communication between the pockets on either side of the rotor vanes short-cut means, these higher pressure peaks can be used to support the oil flow from the pockets on the first side of the vanes to the other side of the vanes. This additional shift of fluid from the first pockets towards the second or vice versa will increase the performance of the phaser without the need of using a pump with a larger capacity.

According to a preferred embodiment of the present invention, the control means comprises first rotor-apertures and second rotor-apertures, positioned on opposite sides of the vanes, and a control ring, co-axial with the rotor, wherein the control ring is provided with one or more recesses or apertures permitting selective communication between the first and the second rotor-apertures, drive means being provided for adjusting the angular position of the control ring with respect to the rotational axis thereof to adjust the timing of the opening and closing of communication between the first and second rotor apertures.

In one embodiment, the control ring does not rotate with the rotor and the stator along the rotational axis of the assembly. The angular position of the ring can be adjusted by the drive means to alter the opening and closing of communication between the pockets of the stator recess with respect to the angular position of the camshaft. The control ring comprises first ring-apertures and second ring-apertures, able to align with the first rotor-apertures in order to bring the first pocket in communication with a reservoir for receiving fluid, and second ring-apertures, able to align at the same time with the second rotor-apertures in order to bring the second pocket in communication with said reservoir, in order to thereby allow communication between the first and second pockets via the reservoir.

According to the present invention it is possible that the drive means are adapted to rotate the ring with respect to its rotational axis. Alternatively, it is possible that the drive means comprise a cam-cam follower system for converting a translational movement of the drive means into a rotational movement of the ring.

In an alternative embodiment the control ring is axially adjustable with respect to the rotor to alter the opening and closing of communication between the pockets of the stator recess with respect to the angular position of the camshaft. In such embodiment, the control ring may be provided with spiral slots or grooves on the periphery thereof alignable with the rotor-apertures in order to bring the first pocket in communication with the second pocket in communication in order to thereby allow communication between the first and second pockets. In such embodiment, the control ring is rotatably fixed to prevent rotation of the control ring.

According to the invention, it is possible that the drive means comprise a stepper motor. It should be understood, however, that the scope of the present invention encompasses alternative drive means for changing the angular or axial position of the control ring.

BRIEF DESCRIPTION OF THE DRAWINGS

The present invention will now be described with reference to the accompanying drawings wherein.

DESCRIPTION OF PREFERRED EMBODIMENTS

Figure 1:
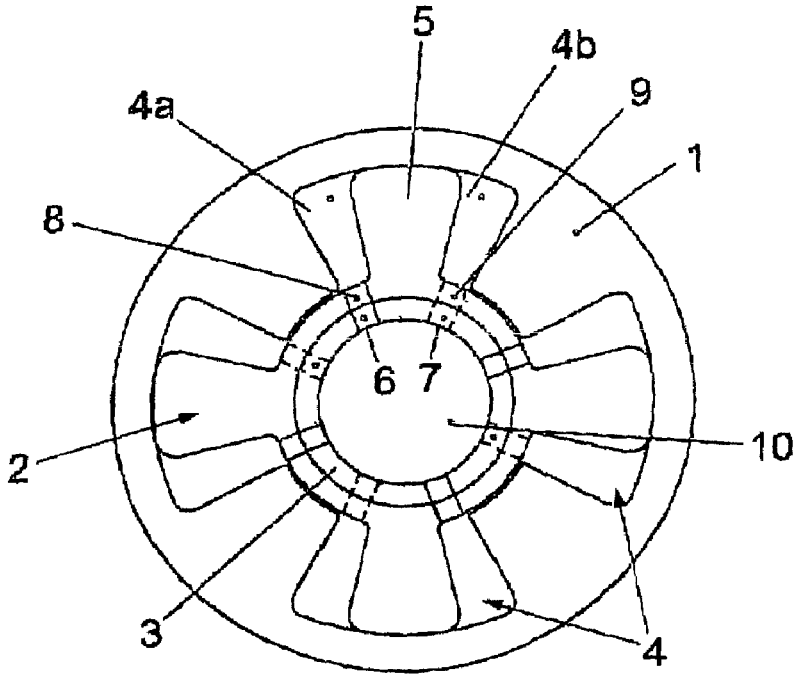
FIG. 1 shows the stator, rotor and ring according to the present invention.

FIG. 1 shows the assembly of a stator 1, a rotor 2 and a ring 3. According to FIG. 1, the stator 1 is provided with four recesses 4. The rotor is provided with four vanes 5. Each of the vanes 5, divide each of the recesses 4 into a first pocket 4*a* and second pocket 4*b*.

The pockets 4*a* and 4*b* are capable for receiving fluid, such as oil under pressure. An increase of pressure in pockets 4*a* will move vanes 5 in a direction clockwise with respect to the stator 1. An increase in the oil pressure in pockets 4*b* will move vanes 5 in the opposite direction. That means that by controlling the fluid pressure in both pockets 4*a* and 4*b*, the angular position of the rotor 2 with respect to the stator 1 can be manipulated.

The fluid pressure in the pockets 4*a* and 4*b* will be regulated using the engine oil pressure. In case the pressure in pocket 4*a* is to be increased, the passage to pocket 4*b* will be opened to allow fluid to flow out of pocket 4*b*. In case the engine oil pressure would be the only mechanism to control the relative movement of the stator 1 and the rotor 2, the movement of the two parts would be dependent on the instantaneous oil pressure. When the latter is low, the rotor moves very slowly, or not at all, with respect to the stator.

During the use of the phaser, pressure pulsations in pockets 4*a* and 4*b* on either side of the vanes 5 will reach values which are significantly higher than the engine oil pressure. These pressure pulsations are caused by the inherent torque reversals of the camshaft 11 (shown in FIG. 2). In order to use these pressure pulsations in pockets 4*a* and 4*b* an additional control ring 3 is present in the phaser according to the invention. The control ring 3 is co-axial with both the rotor 2 and the stator 1. Control ring 3 is capable of rotating with respect to rotor 2 and is mounted to be stationary with respect to the cylinder head, albeit angularly adjustable with respect thereto as will be described below. The control ring 3 comprises four first ring-apertures 6 and four second ring-apertures 7. The rotor 2 is provided with four first rotor-apertures 8 and four second rotor-apertures 9. In case the first ring-apertures 6 of the control ring 3 are in line with the first rotor-apertures 8 in the rotor 2, a connection is created between the first pocket 4*a* and a central reservoir 10 for receiving fluid.

As shown in FIG. 1, at the same time, the second ring-apertures 7 of the control ring 3 are in line with the second rotor-apertures 9 of the rotor 2, creating a connection between the pockets 4*b* and the central reservoir 10 for receiving fluid.

The control ring 3 does not rotate with the rotor 2, but is rather stationery with respect to the cylinder head. However, its angular position with respect to the camshaft can be adjusted by a drive means, such as a stepper motor. The drive means will be controlled, for example, by the engine control unit to position the ring-apertures 6 and 7 relative to the rotor-apertures 8 and 9 in order to ensure that the connection between both the pockets 4*a* and 4*b* and the central reservoir for fluid is established at a cam angle that represents a pressure difference between the first pockets 4*a* and the second pockets 4*b*.

For example, when the phaser is to be commanded to advance, meaning that rotor 2 will turn clockwise relative to stator 1, the control ring 3 is adjusted so that the pockets 4*a* and 4*b* are connected at a time when the pressure in the second pocket 4*b* is higher than the pressure in the first pocket 4*a*, causing the fluid to flow into the first pocket 4*a*, and thereby enabling the phasing activity.

Figure 2:
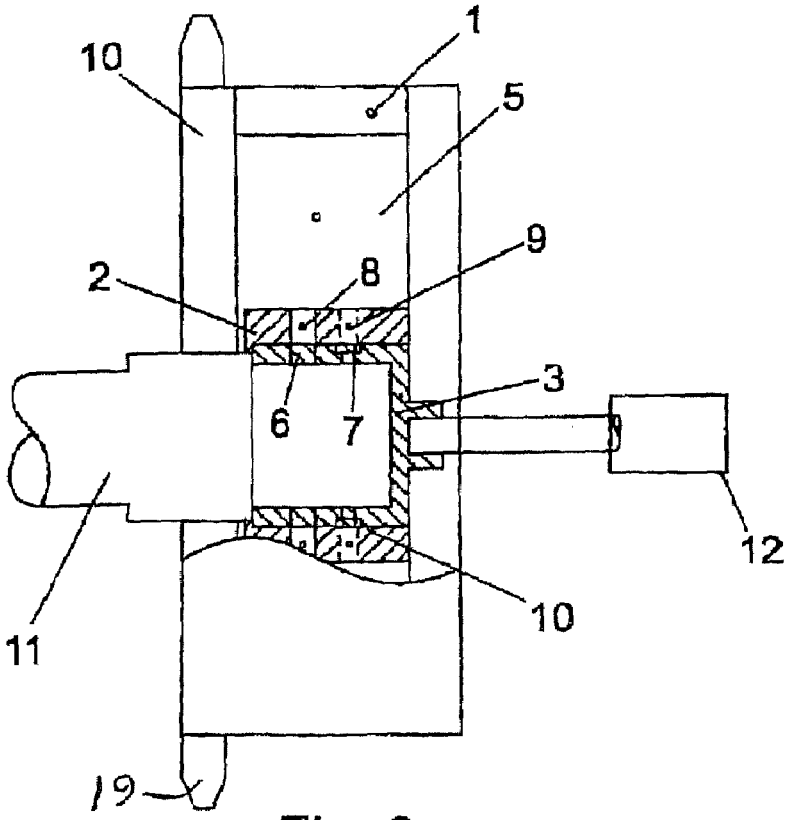
FIG. 2 shows, in cross section, part of the phaser according to the present invention.

In FIG. 2 a side cross sectional view of part of the phaser according to one embodiment of the invention is shown. FIG. 2 shows the stator 1 which is connected to a timing gear 19. The rotor 2 is connected to a camshaft 11, the phaser allowing rotational movement of the camshaft with respect to the timing gear 19. In order to use pressure differences between pockets 4*a* and 4*b* as described with reference to FIG. 1, the angular position of the control ring 3 should be determined. Therefore, drive means 12 are present to control the angular position of the control ring 3 with respect to rotational axis thereof. The ring 3 is provided with first ring-apertures 6 and second ring-aperture 7. Those apertures are to be brought in line, at the appropriate time, with the rotor-apertures 8 and 9 in the rotor 2.

Figure 3:
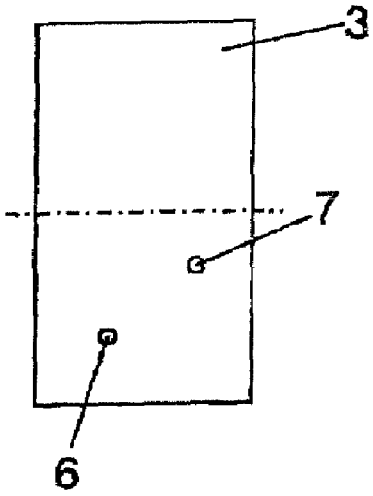
FIGS. 3-6 show views of the control ring and rotor in accordance with various embodiments of the present invention.

FIG. 3 provides a side view of the control ring according to the present invention. In the ring 3, first ring-apertures 6 and second ring-apertures 7 are shown.

Figure 4:
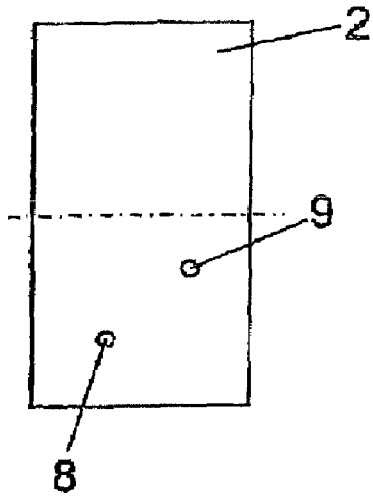
Figure 5:
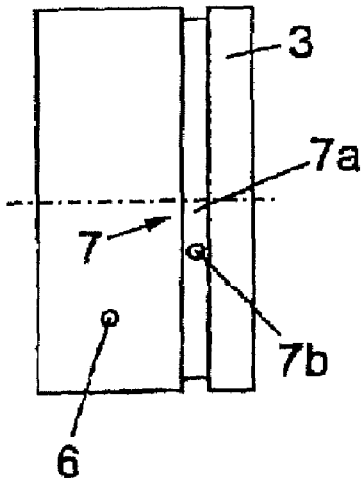

FIG. 4 provides a top view of the rotor 2 provided with rotor-apertures 8, 9. In order to control the connection of the pockets 4*a* and 4*b* as described with respect to FIG. 1, an alternate embodiment of the second ring-aperture 7 is shown in FIG. 5.

Alternatively, it is possible to have a first ring-aperture 6 with a similar configuration. This feature will have the effect that at least one of ring-apertures 6 or 7 is permanently connected to the central cavity 10. Groove 7*a* in the surface of the ring 3, is connected to through-hole 7*b* which is connectable to the central recess 10 for receiving fluid (see FIG. 2).

Alternative to an angular adjustment of the control ring, it is possible to use an axial movement of the control ring to affect the opening and closing of the apertures by the use of a spiral slot or groove in the control ring as will be described in more detail below.

Figure 6:
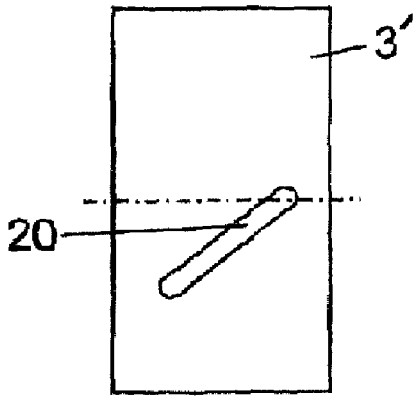

In FIG. 6, another embodiment of the invention is shown wherein the control ring 3' is axially adjustable with respect to the rotor 2 but rotationally fixed with respect to the cylinder head. The control ring 3' is provided with a spiral connecting slot or groove 20 providing selective communication between the holes 8 and 9 of the rotor 2. According to this embodiment, the groove 20 provides a shortcut between the holes 8 and 9 as the holes 8,9 of the rotor 2 pass over the groove 20 during rotation of the rotor.

The use of a groove rather than a slot enables the fluid to be displaced from a first pocket towards a second pocket, via the connecting groove 20 without needing to enter the central reservoir. The timing of the passage of the holes 8,9 over the groove 20 can be altered with respect to the cam timing by axially adjusting the position of the control ring 3' with respect to the rotor 2.

What is claimed is:

1. A phaser for controlling the timing between a camshaft and a timing gear, the phaser comprising:

a rotor having at least one vane, the rotor being connectable to one of the camshaft and the timing gear for rotation therewith;

a stator, co-axially surrounding the rotor, provided with at least one recess for receiving the at least one vane of the rotor and allowing rotational movement of the rotor with respect to the stator, the stator being connectable to the other of the camshaft and the timing gear, wherein the at least one vane divides the at least one recess into a first pocket and a second pocket, the first and second pockets being able to receive fluids under pressure, wherein the introduction of a fluid into the first pocket causes the rotor to move in a first rotational direction relative to the stator, and in that the introduction of a fluid in the second pocket causes the rotor to move in the opposite rotational direction relative to the stator;

wherein the phaser comprises control means for controlling the fluid pressure on opposite sides of the at least one vane to thereby control the angular position of the rotor with respect to the stator;

wherein the control means comprise means for selectively adjusting the timing of the opening and closing of a connection between the first and second pockets in order to allow fluid to flow between the first and second pockets using the pressure difference of the fluid in each of the pockets to transport the fluid from the one to the other pocket; and wherein the means for selectively adjusting comprises first rotor-apertures and second rotor-apertures, positioned on opposite sides of the at least one vane, and a control ring, co-axial with the rotor, wherein the control ring is provided with one or more apertures permitting selective communication between the first and the second rotor-apertures, and a driver for adjusting an angular position of the control ring with respect to a rotational axis of the phaser to adjust the timing of the opening and closing of communication between the first and second rotor-apertures.

2. A phaser in accordance with claim 1, wherein the control means is capable of timing the opening of the connection between the first and second pockets with the occurrence of peak pressures in one of the first or second pockets, caused by the inherent torque reversals of the camshaft.

3. A phaser in accordance with claim 1, wherein the driver comprises a stepper motor.

4. A phaser in accordance with claim 1, wherein the control ring is axially adjustable with respect to the rotor along the rotational axis of the phaser to alter the opening and closing of communication between the first and second pockets of the at least one recess with respect to an angular position of the camshaft.

5. A phaser as claimed in claim 4, wherein the control ring is provided with a spiral groove on a periphery thereof alignable with rotor-apertures in order to bring the first pocket in communication with the second pocket in order to thereby allow communication between the first and second pockets.

6. A phaser in accordance with claim 1, wherein the control ring does not rotate with the rotor and the stator along the rotational axis of the phaser.

7. A phaser in accordance with claim 6, wherein the angular position of the control ring can be adjusted by the driver to alter the opening and closing of communication between the first and second pockets of the at least one recess with respect to the angular position of the camshaft.

8. A phaser in accordance with claim 1, wherein the control ring comprises first ring-apertures and second ring-apertures, one of the first or second ring-apertures able to align with the first rotor-apertures in order to bring the first pocket in communication with a reservoir for receiving fluid, and the other of the first or second ring-apertures, able to align at the same time with the second rotor-apertures in order to bring the second pocket in communication with the reservoir, in order to thereby allow communication between the first and second pockets via the reservoir.

9. A phaser in accordance with claim 8 wherein the control ring further comprises an annular groove formed on the a surface of the control ring in fluid communication with at least one of the first or second ring-apertures.

* * * * *